US008531369B2

(12) United States Patent
Toyooka

(10) Patent No.: US 8,531,369 B2
(45) Date of Patent: Sep. 10, 2013

(54) ELECTRO-OPTIC DEVICE AND ELECTRONIC APPARATUS

(75) Inventor: Takashi Toyooka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 325 days.

(21) Appl. No.: 13/005,458

(22) Filed: Jan. 12, 2011

(65) Prior Publication Data

US 2011/0176080 A1 Jul. 21, 2011

(30) Foreign Application Priority Data

Jan. 19, 2010 (JP) ..... 2010-009126

(51) Int. Cl.
*G09G 3/36* (2006.01)

(52) U.S. Cl.
USPC ..... 345/89; 345/88; 345/690

(58) Field of Classification Search
USPC ..... 345/87–89, 76–83, 204, 690
See application file for complete search history.

(56) References Cited

U.S. PATENT DOCUMENTS

| | | | | |
|---|---|---|---|---|
| 6,980,179 | B2 * | 12/2005 | Yatsuda et al. | 345/63 |
| 7,084,861 | B2 | 8/2006 | Iisaka | |
| 2002/0158857 | A1 | 10/2002 | Iisaka | |
| 2003/0193487 | A1 * | 10/2003 | Yatsuda et al. | 345/204 |
| 2006/0012614 | A1 | 1/2006 | Asao et al. | |
| 2008/0259099 | A1 * | 10/2008 | Arai et al. | 345/690 |

FOREIGN PATENT DOCUMENTS

JP 2007-148417 6/2007

* cited by examiner

*Primary Examiner* — Kimnhung Nguyen
(74) *Attorney, Agent, or Firm* — Maschoff Brennan

(57) ABSTRACT

An electro-optic device including: a plurality of pixels disposed corresponding to a plurality of colors; and a drive circuit adapted to drive the pixels, wherein the drive circuit drives the pixels based on a drive voltage set for each of the colors in accordance with a mixture ratio between the colors, and a drive pattern provided in accordance with the drive voltage and adapted to designate one of switching ON and OFF of the pixels at each of sub-fields constituting a frame in accordance with a grayscale level, and the drive voltages are set so that a voltage range of the drive voltage is different between the pixel corresponding to at least one of the colors and the pixel corresponding to another of the colors, the colors having respective proportions of mixture different from each other.

8 Claims, 9 Drawing Sheets

200R

1: ON-DRIVE
0: OFF-DRIVE

| | | SF CODE | | | | | | | | | | | | | | | | | | | |
|---|---|---|---|---|---|---|---|---|---|---|---|---|---|---|---|---|---|---|---|---|---|
| | | c1 | c2 | c3 | c4 | c5 | c6 | c7 | c8 | c9 | c10 | c11 | c12 | c13 | c14 | c15 | c16 | c17 | c18 | c19 | c20 |
| GRAYSCALE LEVELS | 0 | 0 | 0 | 0 | 0 | 0 | 0 | 0 | 0 | 0 | 0 | 0 | 0 | 0 | 0 | 0 | 0 | 0 | 0 | 0 | 0 |
| | 1 | 1 | 0 | 0 | 0 | 0 | 0 | 0 | 0 | 0 | 0 | 0 | 0 | 0 | 0 | 0 | 0 | 0 | 0 | 0 | 0 |
| | 2 | 1 | 0 | 1 | 0 | 0 | 0 | 0 | 0 | 0 | 0 | 0 | 0 | 0 | 0 | 0 | 0 | 0 | 0 | 0 | 0 |
| | 3 | 1 | 1 | 0 | 0 | 0 | 0 | 0 | 0 | 0 | 0 | 0 | 0 | 0 | 0 | 0 | 0 | 0 | 0 | 0 | 0 |
| | 255 | 1 | 1 | 1 | 1 | 1 | 1 | 1 | 1 | 1 | 1 | 1 | 1 | 1 | 1 | 1 | 1 | 1 | 1 | 1 | 1 |

FIG. 5A

200G

| | | SF CODE | | | | | | | | | | | | | | | | | | | |
|---|---|---|---|---|---|---|---|---|---|---|---|---|---|---|---|---|---|---|---|---|---|
| | | c1 | c2 | c3 | c4 | c5 | c6 | c7 | c8 | c9 | c10 | c11 | c12 | c13 | c14 | c15 | c16 | c17 | c18 | c19 | c20 |
| GRAYSCALE LEVELS | 0 | 0 | 0 | 0 | 0 | 0 | 0 | 0 | 0 | 0 | 0 | 0 | 0 | 0 | 0 | 0 | 0 | 0 | 0 | 0 | 0 |
| | 1 | 1 | 0 | 0 | 0 | 0 | 0 | 0 | 0 | 0 | 0 | 0 | 0 | 0 | 0 | 0 | 0 | 0 | 0 | 0 | 0 |
| | 2 | 1 | 0 | 1 | 0 | 0 | 0 | 0 | 0 | 0 | 0 | 0 | 0 | 0 | 0 | 0 | 0 | 0 | 0 | 0 | 0 |
| | 3 | 1 | 1 | 0 | 0 | 0 | 0 | 0 | 0 | 0 | 0 | 0 | 0 | 0 | 0 | 0 | 0 | 0 | 0 | 0 | 0 |
| | 255 | 1 | 1 | 1 | 1 | 1 | 1 | 1 | 1 | 1 | 1 | 1 | 1 | 1 | 1 | 1 | 1 | 1 | 1 | 1 | 1 |

FIG. 5B

200B

| | | SF CODE | | | | | | | | | | | | | | | | | | | |
|---|---|---|---|---|---|---|---|---|---|---|---|---|---|---|---|---|---|---|---|---|---|
| | | c1 | c2 | c3 | c4 | c5 | c6 | c7 | c8 | c9 | c10 | c11 | c12 | c13 | c14 | c15 | c16 | c17 | c18 | c19 | c20 |
| GRAYSCALE LEVELS | 0 | 0 | 0 | 0 | 0 | 0 | 0 | 0 | 0 | 0 | 0 | 0 | 0 | 0 | 0 | 0 | 0 | 0 | 0 | 0 | 0 |
| | 1 | 1 | 0 | 0 | 0 | 0 | 0 | 0 | 0 | 0 | 0 | 0 | 0 | 0 | 0 | 0 | 0 | 0 | 0 | 0 | 0 |
| | 2 | 1 | 0 | 1 | 0 | 0 | 0 | 0 | 0 | 0 | 0 | 0 | 0 | 0 | 0 | 0 | 0 | 0 | 0 | 0 | 0 |
| | 3 | 1 | 1 | 0 | 0 | 0 | 0 | 0 | 0 | 0 | 0 | 0 | 0 | 0 | 0 | 0 | 0 | 0 | 0 | 0 | 0 |
| | 255 | 1 | 1 | 1 | 1 | 1 | 1 | 1 | 1 | 1 | 1 | 1 | 1 | 1 | 1 | 1 | 1 | 1 | 1 | 1 | 1 |

FIG. 5C

201R

1: ON-DRIVE
0: OFF-DRIVE

| | | SF CODE | | | | | | | | | | | | | | | | | | | |
|---|---|---|---|---|---|---|---|---|---|---|---|---|---|---|---|---|---|---|---|---|---|
| | | c1 | c2 | c3 | c4 | c5 | c6 | c7 | c8 | c9 | c10 | c11 | c12 | c13 | c14 | c15 | c16 | c17 | c18 | c19 | c20 |
| GRAYSCALE LEVELS | 0 | 0 | 0 | 0 | 0 | 0 | 0 | 0 | 0 | 0 | 0 | 0 | 0 | 0 | 0 | 0 | 0 | 0 | 0 | 0 | 0 |
| | 1 | 1 | 0 | 0 | 0 | 0 | 0 | 0 | 0 | 0 | 0 | 0 | 0 | 0 | 0 | 0 | 0 | 0 | 0 | 0 | 0 |
| | 2 | 1 | 0 | 1 | 0 | 0 | 0 | 0 | 0 | 0 | 0 | 0 | 0 | 0 | 0 | 0 | 0 | 0 | 0 | 0 | 0 |
| | 3 | 1 | 1 | 0 | 0 | 0 | 0 | 0 | 0 | 0 | 0 | 0 | 0 | 0 | 0 | 0 | 0 | 0 | 0 | 0 | 0 |
| | 255 | 1 | 1 | 1 | 1 | 1 | 1 | 1 | 1 | 1 | 1 | 1 | 1 | 1 | 1 | 1 | 1 | 1 | 1 | 1 | 1 |

FIG. 6A

201G

| | | SF CODE | | | | | | | | | | | | | | | | | | | |
|---|---|---|---|---|---|---|---|---|---|---|---|---|---|---|---|---|---|---|---|---|---|
| | | c1 | c2 | c3 | c4 | c5 | c6 | c7 | c8 | c9 | c10 | c11 | c12 | c13 | c14 | c15 | c16 | c17 | c18 | c19 | c20 |
| GRAYSCALE LEVELS | 0 | 0 | 0 | 0 | 0 | 0 | 0 | 0 | 0 | 0 | 0 | 0 | 0 | 0 | 0 | 0 | 0 | 0 | 0 | 0 | 0 |
| | 1 | 1 | 0 | 1 | 0 | 0 | 0 | 0 | 0 | 0 | 0 | 0 | 0 | 0 | 0 | 0 | 0 | 0 | 0 | 0 | 0 |
| | 2 | 1 | 1 | 0 | 1 | 0 | 0 | 0 | 0 | 0 | 0 | 0 | 0 | 0 | 0 | 0 | 0 | 0 | 0 | 0 | 0 |
| | 3 | 1 | 1 | 1 | 0 | 0 | 0 | 0 | 0 | 0 | 0 | 0 | 0 | 0 | 0 | 0 | 0 | 0 | 0 | 0 | 0 |
| | 255 | 1 | 1 | 1 | 1 | 1 | 1 | 1 | 1 | 1 | 1 | 1 | 1 | 1 | 1 | 1 | 1 | 1 | 1 | 1 | 1 |

FIG. 6B

201B

| | | SF CODE | | | | | | | | | | | | | | | | | | | |
|---|---|---|---|---|---|---|---|---|---|---|---|---|---|---|---|---|---|---|---|---|---|
| | | c1 | c2 | c3 | c4 | c5 | c6 | c7 | c8 | c9 | c10 | c11 | c12 | c13 | c14 | c15 | c16 | c17 | c18 | c19 | c20 |
| GRAYSCALE LEVELS | 0 | 0 | 0 | 0 | 0 | 0 | 0 | 0 | 0 | 0 | 0 | 0 | 0 | 0 | 0 | 0 | 0 | 0 | 0 | 0 | 0 |
| | 1 | 1 | 1 | 0 | 0 | 0 | 0 | 0 | 0 | 0 | 0 | 0 | 0 | 0 | 0 | 0 | 0 | 0 | 0 | 0 | 0 |
| | 2 | 1 | 1 | 1 | 0 | 0 | 0 | 0 | 0 | 0 | 0 | 0 | 0 | 0 | 0 | 0 | 0 | 0 | 0 | 0 | 0 |
| | 3 | 1 | 1 | 1 | 0 | 1 | 0 | 0 | 0 | 0 | 0 | 0 | 0 | 0 | 0 | 0 | 0 | 0 | 0 | 0 | 0 |
| | 255 | 1 | 1 | 1 | 1 | 1 | 1 | 1 | 1 | 1 | 1 | 1 | 1 | 1 | 1 | 1 | 1 | 1 | 1 | 1 | 1 |

FIG. 6C

| | | SF CODE | | | | | | | | | | | | | | | | | | | |
|---|---|---|---|---|---|---|---|---|---|---|---|---|---|---|---|---|---|---|---|---|---|
| | | c1 | c2 | c3 | c4 | c5 | c6 | c7 | c8 | c9 | c10 | c11 | c12 | c13 | c14 | c15 | c16 | c17 | c18 | c19 | c20 |
| GRAYSCALE LEVELS | 0 | 0 | 0 | 0 | 0 | 0 | 0 | 0 | 0 | 0 | 0 | 0 | 0 | 0 | 0 | 0 | 0 | 0 | 0 | 0 | 0 |
| | 1 | 1 | 0 | 0 | 0 | 0 | 0 | 0 | 0 | 0 | 0 | 1 | 0 | 0 | 0 | 0 | 0 | 0 | 0 | 0 | 0 |
| | 2 | 0 | 1 | 0 | 0 | 0 | 0 | 0 | 0 | 0 | 0 | 0 | 1 | 0 | 0 | 0 | 0 | 0 | 0 | 0 | 0 |
| | 3 | 1 | 1 | 0 | 0 | 0 | 0 | 0 | 0 | 0 | 0 | 1 | 1 | 0 | 0 | 0 | 0 | 0 | 0 | 0 | 0 |
| | 4 | 1 | 0 | 1 | 0 | 0 | 0 | 0 | 0 | 0 | 0 | 1 | 0 | 1 | 0 | 0 | 0 | 0 | 0 | 0 | 0 |
| | | | | | | | | | | | | | | | | | | | | | |
| | 253 | 0 | 0 | 1 | 1 | 1 | 1 | 1 | 1 | 1 | 1 | 0 | 1 | 0 | 1 | 1 | 1 | 1 | 1 | 1 | 1 |
| | 254 | 1 | 0 | 1 | 1 | 1 | 1 | 1 | 1 | 1 | 1 | 0 | 0 | 1 | 1 | 1 | 1 | 1 | 1 | 1 | 1 |
| | 255 | 1 | 1 | 1 | 1 | 1 | 1 | 1 | 1 | 1 | 1 | 1 | 1 | 1 | 1 | 1 | 1 | 1 | 1 | 1 | 1 |

1: ON-DRIVE
0: OFF-DRIVE

203G

1: ON-DRIVE
0: OFF-DRIVE

| | | SF CODE | | | | | | | | | | | | | | | | | | | |
|---|---|---|---|---|---|---|---|---|---|---|---|---|---|---|---|---|---|---|---|---|---|
| | | c1 | c2 | c3 | c4 | c5 | c6 | c7 | c8 | c9 | c10 | c11 | c12 | c13 | c14 | c15 | c16 | c17 | c18 | c19 | c20 |
| GRAYSCALE LEVELS | 0 | 0 | 0 | 0 | 0 | 0 | 0 | 0 | 0 | 0 | 0 | 0 | 0 | 0 | 0 | 0 | 0 | 0 | 0 | 0 | 0 |
| | 1 | 1 | 0 | 0 | 0 | 0 | 0 | 0 | 0 | 0 | 0 | 1 | 0 | 0 | 0 | 0 | 0 | 0 | 0 | 0 | 0 |
| | 2 | 0 | 1 | 0 | 0 | 0 | 0 | 0 | 0 | 0 | 0 | 0 | 1 | 0 | 0 | 0 | 0 | 0 | 0 | 0 | 0 |
| | 3 | 1 | 1 | 0 | 0 | 0 | 0 | 0 | 0 | 0 | 0 | 1 | 1 | 0 | 0 | 0 | 0 | 0 | 0 | 0 | 0 |
| | 4 | 1 | 0 | 1 | 0 | 0 | 0 | 0 | 0 | 0 | 0 | 1 | 0 | 1 | 0 | 0 | 0 | 0 | 0 | 0 | 0 |
| | 253 | 0 | 0 | 1 | 1 | 1 | 1 | 1 | 1 | 1 | 1 | 0 | 0 | 1 | 1 | 1 | 1 | 1 | 1 | 1 | 1 |
| | 254 | 1 | 0 | 1 | 1 | 1 | 1 | 1 | 1 | 1 | 1 | 1 | 0 | 1 | 1 | 1 | 1 | 1 | 1 | 1 | 1 |
| | 255 | 1 | 1 | 1 | 1 | 1 | 1 | 1 | 1 | 1 | 1 | 1 | 1 | 1 | 1 | 1 | 1 | 1 | 1 | 1 | 1 |

FIG. 11

203B

| | | SF CODE | | | | | | | | | | | | | | | | | | | |
|---|---|---|---|---|---|---|---|---|---|---|---|---|---|---|---|---|---|---|---|---|---|
| | | c1 | c2 | c3 | c4 | c5 | c6 | c7 | c8 | c9 | c10 | c11 | c12 | c13 | c14 | c15 | c16 | c17 | c18 | c19 | c20 |
| GRAYSCALE LEVELS | 0 | 0 | 0 | 0 | 0 | 0 | 0 | 0 | 0 | 0 | 0 | 0 | 0 | 0 | 0 | 0 | 0 | 0 | 0 | 0 | 0 |
| | 1 | 1 | 0 | 0 | 0 | 0 | 0 | 0 | 0 | 0 | 0 | 1 | 0 | 0 | 0 | 0 | 0 | 0 | 0 | 0 | 0 |
| | 2 | 0 | 1 | 0 | 0 | 0 | 0 | 0 | 0 | 0 | 0 | 0 | 1 | 0 | 0 | 0 | 0 | 0 | 0 | 0 | 0 |
| | 3 | 1 | 1 | 0 | 0 | 0 | 0 | 0 | 0 | 0 | 0 | 1 | 1 | 0 | 0 | 0 | 0 | 0 | 0 | 0 | 0 |
| | 4 | 1 | 0 | 1 | 0 | 0 | 0 | 0 | 0 | 0 | 0 | 1 | 0 | 1 | 0 | 0 | 0 | 0 | 0 | 0 | 0 |
| | 253 | 1 | 0 | 1 | 1 | 1 | 1 | 1 | 1 | 1 | 1 | 0 | 0 | 1 | 1 | 1 | 1 | 1 | 1 | 1 | 1 |
| | 254 | 0 | 1 | 1 | 1 | 1 | 1 | 1 | 1 | 1 | 1 | 1 | 1 | 0 | 1 | 1 | 1 | 1 | 1 | 1 | 1 |
| | 255 | 1 | 1 | 1 | 1 | 1 | 1 | 1 | 1 | 1 | 1 | 1 | 1 | 1 | 1 | 1 | 1 | 1 | 1 | 1 | 1 |

FIG. 12

ELECTRO-OPTIC DEVICE AND ELECTRONIC APPARATUS

BACKGROUND

1. Technical Field

The present invention relates to a technology of driving a pixel to an ON-state or OFF-state in each of sub-fields.

2. Related Art

In order to express grayscale in electro-optic devices having display elements such as liquid crystal elements or electroluminescence (EL) elements as pixels, the following technology has been proposed. That is, there has been proposed a technology of driving the pixel to either one of ON-state and OFF-state in each of sub-fields obtained by dividing a frame (a field) while varying the ratio of the time periods in which the pixel is driven to the ON-state and OFF-state, respectively, to thereby express the grayscale (see JP-A-2007-148417).

Incidentally, in the case of expressing an image to be displayed with three primary colors of red (R), green (G), and blue (B), it is possible to provide an electro-optic device for each color, and combine the images of the respective colors obtained by the respective electro-optic devices to thereby obtain a color image. On this occasion, by adjusting the white balance of the image, the mixture ratio between the three colors of R, G, and B might become different from "1:1:1".

For example, in the case in which the mixture ratio of the colors R, G, and B becomes equal to "1:0.6:0.5", the electro-optic device for displaying a red image displays all of the grayscales the electro-optic device can display. In contrast, since the mixture ratio of green to red is "1:0.6", the electro-optic device for displaying a green image uses the grayscale up to an intermediate level thereof if the voltage for the ON-drive is the same as in the electro-optic device for displaying the red image, and is therefore not allowed to display the image with the same number of grayscales as in the red image. Further, since the mixture ratio of blue to red is "1:0.5", the electro-optic device for displaying a blue image also uses the grayscale up to an intermediate level thereof if the voltage for the ON-drive is the same as in the electro-optic device for displaying the red image, and is therefore not allowed to display the image with the same number of grayscales as in the red image.

SUMMARY

An advantage of some aspects of the invention is to provide a technology for preventing the number of grayscales to be displayed from being limited even in the case in which the proportions of mixture of the colors are different from each other in the sub-field drive.

An aspect of the invention relates to an electro-optic device including a plurality of pixels disposed corresponding to a plurality of colors, and a drive circuit adapted to drive the pixels, wherein the drive circuit drives the pixels based on a drive voltage set for each of the colors in accordance with a mixture ratio between the colors, and a drive pattern provided in accordance with the drive voltage and adapted to designate one of switching ON and OFF of the pixels at each of a plurality of sub-fields constituting a frame in accordance with a grayscale level, and the drive voltages are set so that a voltage range of the drive voltage is different between the pixel corresponding to at least one of the colors and the pixel corresponding to another of the colors, the colors having respective proportions of mixture different from each other.

According to this aspect of the invention, it results that the voltage ranges of the drive voltages of the pixels corresponding to the respective colors are different from each other in accordance with the mixture ratio between the colors in the sub-field drive. By making the voltage ranges of the drive voltages different from each other, it is possible to perform the drive with the drive pattern corresponding to the drive voltage, and therefore, by making the voltage ranges of the drive voltages for the respective colors different from each other, it is possible to prevent the number of grayscale levels from being limited.

In this aspect of the invention, it is also possible that the drive circuit changes the voltage range of the drive voltage for the pixels corresponding to each of the colors in accordance with the mixture ratio of the plurality of colors, the voltage range corresponding to the number of grayscale levels the same between the colors. According to this configuration, the proportion of mixture is set for each of the colors, and the proportions of mixture of the respective colors can be adjusted to the set proportions of mixture even if the ON-drive is performed throughout the entire period of the frame in each of the colors.

Further, in the configuration described above, it is also possible that the plurality of sub-fields have respective periods the same as each other, and the drive pattern of the pixel corresponding to the color having narrower one of the voltage ranges of the drive voltages corresponding to the mixture ratio of the plurality of colors has a longer period during which an ON-drive of the pixel continues compared to the drive pattern of the pixel corresponding to the color having wider one of the voltage ranges of the drive voltages at the same grayscale level.

Further, in the configuration described above, it is also possible that the plurality of sub-fields include at least one sub-field having a different period, and the period of the sub-field having a different period related to the drive of the pixel of the color having narrower one of the voltage ranges of the drive voltages corresponding to the mixture ratio of the plurality of colors is longer than the period of the corresponding sub-field having a different period related to the drive of the pixel of the color having wider one of the voltage ranges of the drive voltages.

Further, in the configuration described above, it is also possible that at a maximum grayscale level, the pixel is driven with the drive pattern designating switching ON of the pixel at all of the plurality of sub-fields.

It should be noted that the invention can be recognized not only as the electro-optic device, but can also be recognized as an electronic apparatus having the electro-optic device.

BRIEF DESCRIPTION OF THE DRAWINGS

The invention will be described with reference to the accompanying drawings, wherein like numbers reference like elements.

FIGS. 5A, 5B, and 5C are diagrams showing LUTs 200R, 200G, and 200B.

FIGS. 6A, 6B, and 6C are diagrams showing LUTs 201R, 201G, and 201B.

FIG. 11 is a diagram showing an LUT 203G.

FIG. 12 is a diagram showing an LUT 203B.

DESCRIPTION OF EXEMPLARY EMBODIMENTS

First Embodiment

Figure 1:
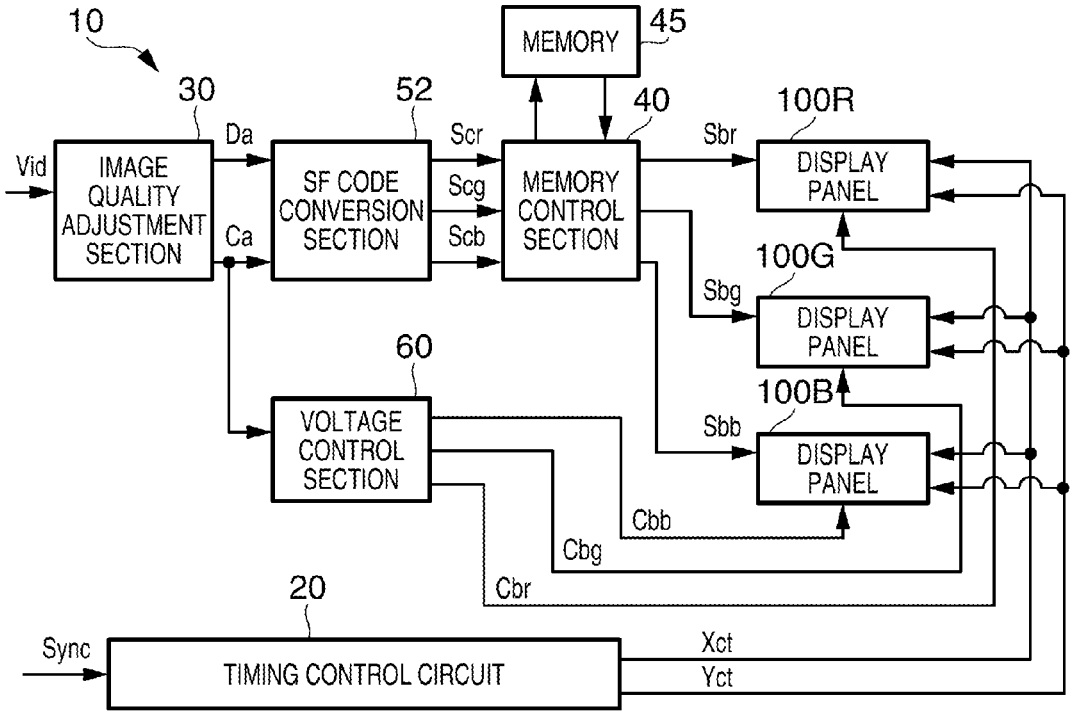
FIG. 1 is a block diagram showing a configuration of an electro-optic device according to a first embodiment of the invention.

FIG. 1 is a block diagram showing an overall configuration of an electro-optic device according to a first embodiment of the invention. As shown in the drawing, an electro-optic device 10 includes a timing control circuit 20, an image quality adjustment section 30, a memory control section 40, a memory 45, an SF code conversion section 52, a voltage control section 60, and display panels 100R, 100G, and 100B. It should be noted that since the display panels 100R, 100G, and 100B have the same configurations, the trailing alphabets are omitted unless any particular discrimination is necessary in the following explanation.

The electro-optic device 10 is supplied with a video signal Vid from a higher-level circuit not shown. The video signal Vid is a signal expressing an image with three components of the three primary colors, namely red (R), green (G), and blue (B). The video signal Vid defines the grayscale levels of each of the pixels in the image for the respective colors of R, G, and B. It should be noted that the video signal Vid is supplied in the order of the pixels to be scanned along a vertical synchronization signal, a horizontal synchronization signal, and a dot clock signal (all not shown) included in a synchronization signal Sync.

The timing control circuit 20 controls each section based on the synchronization signal Sync described above.

The image quality adjustment section 30 performs a preprocess on the brightness, tint, and so on of the image defined by the video signal Vid in accordance with display characteristics of the display panels 100 and status of various operators not shown, and at the same time outputs a video signal Da thus processed. Further, the image quality adjustment section 30 adjusts the mixture ratio between the three components of R, G, and B at the maximum grayscale level in the image in accordance with the operation performed in each of the various operators not shown. For example, in the present embodiment, there are two cases, one is the case in which the mixture ratio between the R component, the G component, and the B component of the image at the maximum grayscale level is set to "1:1:1" by the operator, and the other is the case in which the mixture ratio between the R component, the G component, and the B component of the image at the maximum grayscale level is set to "1:0.6:0.55". By changing the mixture ratio between the R component, the G component, and the B component of the image at the maximum grayscale level, the white balance of the image obtained by combining the images of the respective colors is changed. It should be noted that in the present embodiment the video signal Vid supplied from the higher-level circuit can be an analog signal or a digital signal. In the case of the analog signal, the image quality adjustment section 30 converts the analog signal into a digital signal.

Further, the image quality adjustment section 30 outputs a control signal Ca representing the mixture ratio between the R component, the G component, and the B component to the SF code conversion section 52 and the voltage control section 60.

Figure 2:
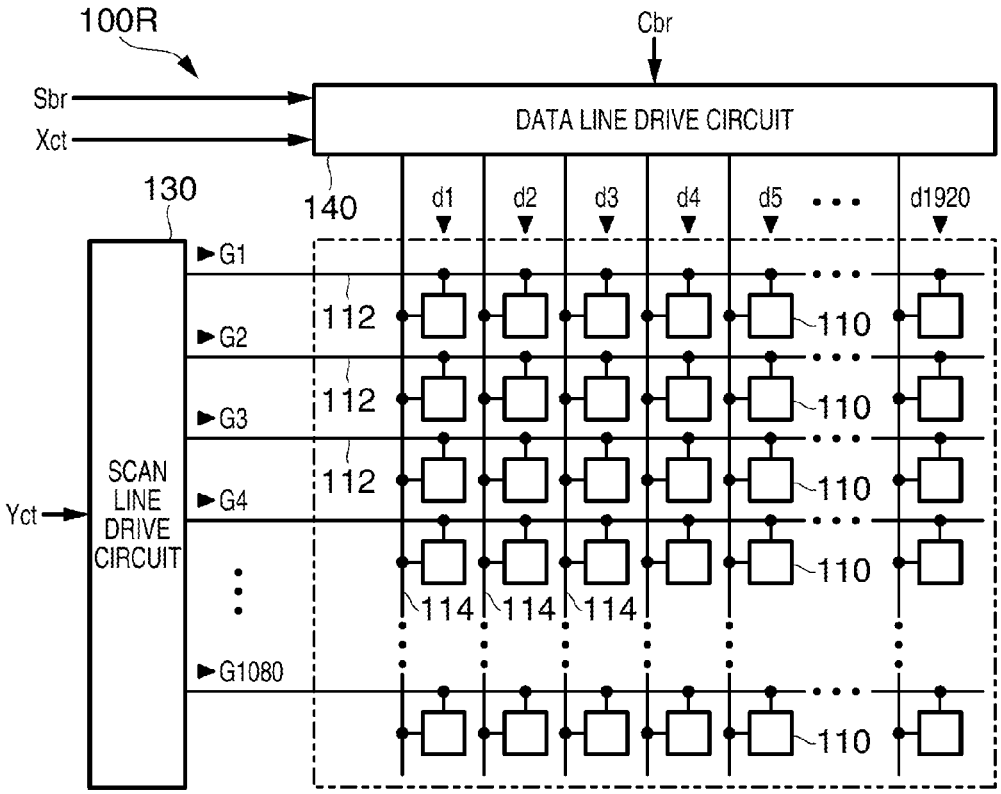
FIG. 2 is a diagram showing a configuration of a display panel in the electro-optic device.

FIG. 2 is a diagram showing a configuration of the display panel 100R. The display panel 100R is, for example, a transmissive liquid crystal display panel of the active matrix type, and for generating a transmission image with transmittance modulated in each of the pixels.

As shown in FIG. 2, the display panel 100R is provided with scan lines 112 at 1st, 2nd, 3rd, . . . , and 1080th lines disposed so as to extend in a lateral direction in the drawing, and is further provided with data lines 114 at 1st, 2nd, 3rd, . . . , and 1920th columns disposed so as to extend in a vertical direction in the drawing and to keep electrical insulation from the scan lines 112. Further, pixels 110 are arranged so as to correspond respectively to the intersections between the 1080 lines of scan lines 112 and the 1920 columns of data lines 114. Therefore, in the present embodiment, the pixels 110 are arranged in a matrix having the 1080 lines arranged in a vertical direction and the 1920 columns arranged in a lateral direction, as a result. It should be noted that the area where the pixels 110 are arranged in such a manner as described above corresponds to a display area 101.

In the periphery of the display area 101, there are disposed a scan line drive circuit 130 and a data line drive circuit 140. Among these circuits, the scan line drive circuit 130 is for supplying the scan lines 112 at the 1st through 1080th lines with the respective scan signals. In the present embodiment, the scan line drive circuit 130 selects the scan lines 112 in the order of the 1st, 2nd, 3rd, . . . , and 1080th lines in accordance with a control signal Yct, and provides the scan signal to the selected scan line with a selection voltage, while providing the scan signal to other scan lines, namely the scan lines not selected, with a non-selection voltage. It should be noted that the scan signals respectively supplied to the scan lines 112 at the 1st, 2nd, 3rd, . . . , and 1080th lines are described as G1, G2, G3, . . . , and G1080, respectively.

Incidentally, the data line drive circuit 140 is for supplying the data lines 114 at the 1st through 1920th columns with the respective data signals in accordance with a control signal Xct supplied from the timing control circuit 20. The data line drive circuit 140 supplies the data signals each corresponding to a sub-field (SF) bit Sbr supplied from the memory control section 40. It should be noted that the data signals respectively supplied to the data lines 114 at the 1st, 2nd, 3rd, . . . , and 1920th columns are described as d1, d2, d3, . . . , and d1920, respectively.

Further, the data line drive circuit 140 sets an ON-level of the data signal for switching ON the pixel 100 in accordance with a control signal Cbr supplied from the voltage control section 60.

It should be noted that the display panels 100G, 100B have the configuration identical to the configuration of the display panel 100R except the signals supplied to the data line drive circuit 140.

The data line drive circuit 140 of the display panel 100G is supplied with a SF bit Sbg from the memory control section 40, and is supplied with a control signal Cbg from the voltage control section 60. The data line drive circuit 140 of the display panel 100G supplies the data signal corresponding to the SF bit Sbg. Further, the data line drive circuit 140 of the display panel 100G sets the ON-level of the data signal corresponding to the control signal Cbg.

Further, the data line drive circuit 140 of the display panel 100B is supplied with a SF bit Sbb from the memory control section 40, and is supplied with a control signal Cbb from the voltage control section 60. The data line drive circuit 140 of the display panel 100B supplies the data signal corresponding to the SF bit Sbb. Further, the data line drive circuit 140 of the display panel 100B sets the ON-level of the data signal corresponding to the control signal Cbb.

Figure 3:
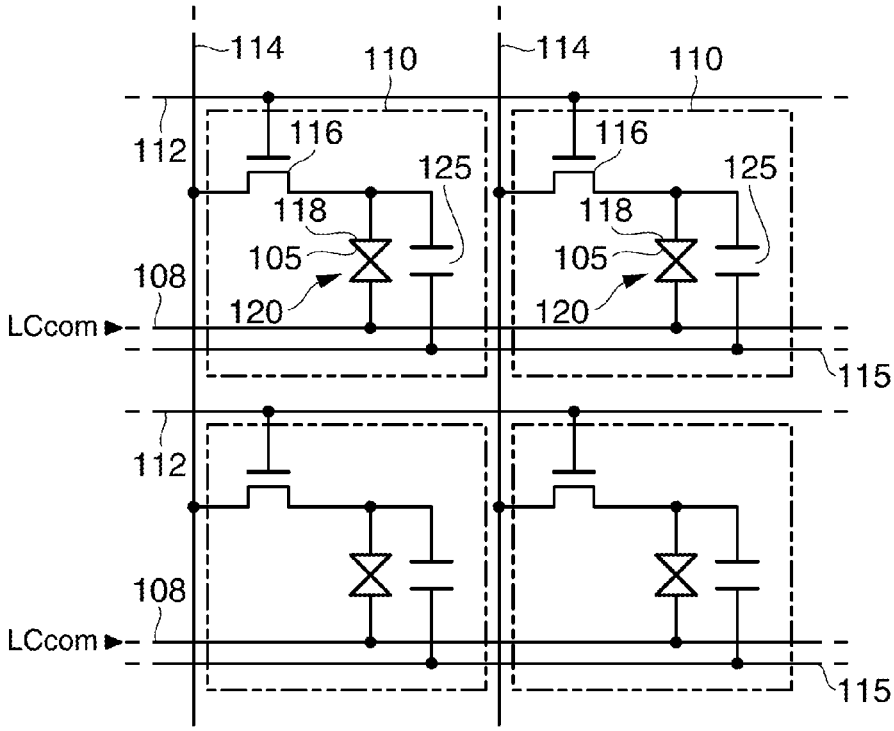
FIG. 3 is a diagram showing a configuration of pixels in the display panel.

FIG. 3 is a diagram showing an example of an equivalent circuit of the pixel 110 in the display panel 100.

As shown in the drawing, the pixel 110 has a configuration including a liquid crystal element 120 having a liquid crystal 105 sandwiched with a pixel electrode 118 and a common electrode 108, and a thin film transistor (hereinafter abbreviated as TFT) 116 switched to a conductive state between the data line 114 and the pixel electrode 118 when the selection voltage is applied to the scan line 112, and switched to a non-conductive state when the non-selection voltage is applied.

It should be noted that the common electrode 108 is common to the pixels, and a voltage LCcom is applied by a circuit omitted from the illustration. Further, in the pixel 110, an auxiliary capacitor (a storage capacitor) 125 is disposed in parallel to the liquid crystal element 120. The auxiliary capacitor 125 has one end connected to the pixel electrode 118, and the other end commonly connected to a capacitance line 115. The capacitance line 115 is temporally kept at a constant voltage.

In such a configuration, in the pixel 110, the TFT 116 is switched to the conductive state when the selection voltage is applied to the scan line 112, and the voltage of the data signal supplied to the data line 114 is applied to the pixel electrode 118. On the other hand, the TFT 116 becomes in the non-conductive state when the application of the selection voltage to the scan line 112 is terminated and the non-selection voltage is applied thereto. However, the liquid crystal element 120 holds the voltage of the data signal, which is applied to the pixel electrode 118 when the TFT 116 is in the conductive state, due to the capacitive property thereof until the selection voltage is applied again to the scan line 112.

Incidentally, since in the present embodiment the pixel 110 is driven to either one of the ON-state and the OFF-state, the data signal is in the ON-level (the voltage level of the drive voltage for switching ON the pixel 110) corresponding to "1" of the SF bit, or the OFF-level (the voltage level of the drive voltage for switching OFF the pixel 110) corresponding to "0" thereof.

Here, assuming that the liquid crystal element 120 is of the normally black mode, the ON-level denotes the level of the data signal for setting the liquid crystal element 120 to the light state by applying the voltage to the liquid crystal element 120, and the OFF-level denotes the level of the data signal for setting the liquid crystal element 120 to the dark state without applying the voltage (or by applying a voltage of making the applied voltage close to zero) to the liquid crystal element 120. When performing alternating-current drive of the liquid crystal element 120, there are required two types of ON-levels, one having a positive polarity higher than the center of the amplitude, the other having a negative polarity lower than the center of the amplitude. On the other hand, the OFF-level is unique, namely the voltage LCcom to be applied to the common electrode 108, and independent of the polarity if no voltage is to be applied to the liquid crystal element 120. However, if the voltage for making the applied voltage close to zero is to be applied thereto, two types of OFF-levels respectively having positive and negative polarities with respect to the center of the amplitude become necessary.

It should be noted that in the present explanation regarding the scan signals and the data signals, a ground potential Gnd not shown is used as the reference of zero voltage. It should be noted that the applied voltage to the liquid crystal element 120 is defined as an electrical potential difference between the voltage LCcom of the common electrode 108 and each of the pixel electrodes 118. Further, it is conceivable that the voltage LCcom to be applied to the common electrode 108 is equal to a voltage at the center of the amplitude described above. It should be noted that the voltage LCcom might be adjusted to be lower than the voltage at the center of the amplitude in some cases taking an off-leak current of the n-channel TFT 116, for example, into consideration.

Figure 4:
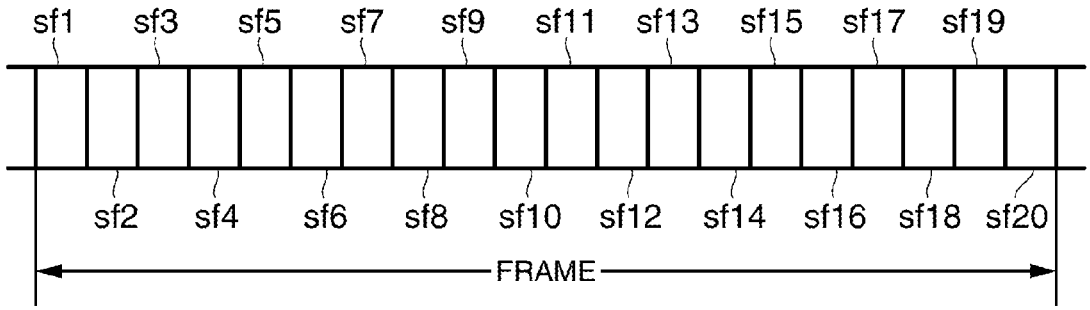
FIG. 4 is a diagram showing a frame in the electro-optic device.

Then, in the present embodiment, the frame corresponding to a unit period for each of the pixels has a configuration shown in FIG. 4.

As shown in the drawing, the frame is divided into totally 20 sub-fields with an equal width. In other words, the divisional sub-fields have weights (time lengths (periods of time)) equal to each other. In the present embodiment, since it results that the frame is composed of 20 sub-fields, in order to distinguish these sub-fields, descriptions of sf1 through sf20 are used in the temporal order.

It should be noted that if the frequency of the vertical synchronization signal Vs is 60 Hz, the frame as the unit period of the scan line corresponds to 16.7 ms, which corresponds to the inverse of the frequency. Further, since ON-drive (application of the drive voltage of the ON-level) or OFF-drive (application of the drive voltage of the OFF-level) in each of the pixels is performed at the moment of selection of the scan line, the frame has the timing different between the scan lines from a temporal point of view in a strict sense.

As described above, in the pixel 110, the ON-level or the OFF-level applied to the pixel electrode 118 at the selection of the scan line 112 is held until the scan line 112 is selected again. Therefore, it results that in order to set the pixel 110 to the state of the ON-drive or the OFF-drive for the period corresponding to a certain sub-field, it is sufficient to set the period from when selecting the scan line and then writing the ON-level or the OFF-level (of the data signal) corresponding to the SF bit into the liquid crystal element 120 to when selecting the same scan line again to the period corresponding to that sub-field.

The voltage control section 60 is for obtaining the control signal Ca supplied from the image quality adjustment section 30, and then setting the voltage of the ON-level of the data signal in accordance with the control signal Ca thus obtained.

If the control signal Ca represents "1:1:1" as the mixture ratio between the R component, G component, and B component, the voltage control section 60 outputs the control signal Cbr, which gives an instruction for setting the voltage of the ON-level to 5V, to the data line drive circuit 140 related to the display panel 100R. Further, the voltage control section 60 outputs the control signal Cbg, which gives an instruction for setting the voltage of the ON-level to 5V, to the data line drive circuit 140 related to the display panel 100G, and the control signal Cbb, which gives an instruction for setting the voltage of the ON-level to 5V, to the data line drive circuit 140 related to the display panel 100B.

Meanwhile, if the control signal Ca represents "1:0.6:0.55" as the mixture ratio between the R component, G component, and B component, the voltage control section 60 outputs the control signal Cbr, which gives an instruction for setting the voltage of the ON-level to 5V, to the data line drive circuit 140 related to the display panel 100R. Further, the voltage control section 60 outputs the control signal Cbg, which gives an instruction for setting the voltage of the ON-level to 3.2V, to the data line drive circuit 140 related to the display panel 100G, and the control signal Cbb, which gives an instruction for setting the voltage of the ON-level to 3V, to the data line drive circuit 140 related to the display panel 100B.

It should be noted that the voltages of the ON-levels corresponding to the case of setting the mixture ratio between the R component, G component, and B component to "1:0.6:0.55" are previously determined in such a manner as described below.

Firstly, the transmittance of the display panel 100 corresponding to the case of setting the ON-level voltage to 5V and keeping the ON-level throughout the one frame period is normalized to 1. Subsequently, the transmittance of the display panel 100 is measured while lowering the voltage of the ON-level keeping the ON-level throughout the entire period of one frame to thereby obtain the voltage-transmittance characteristic (VT characteristic), which is the characteristic obtained by normalizing the transmittance of the display panel 100 between 0 and 1. Thus, the VT characteristic corresponding to the case of varying the ON-level between the OFF-level of 0V and 5V (in a voltage range (dynamic range) between the ON-level and OFF-level of the drive voltage) can be obtained.

Subsequently, in the present embodiment, the ON-level is kept throughout the entire period of one frame when the maximum grayscale level of the G component is set in the display panel 100G. In the case of setting the mixture ratio of the G component to the R component to "1:0.6" (the proportion is set to 0.6), the transmittance is set to 0.6 by keeping the ON-level throughout the entire period of one frame when the G component is set to the maximum grayscale level. In the present embodiment, since the voltage with which the transmittance of 0.6 can be obtained is obtained as 3.2V according to the VT characteristic previously measured, the voltage of the ON-level is set to 3.2V.

Further, in the present embodiment, the ON-level is kept throughout the entire period of one frame when the maximum grayscale level of the B component is set in the display panel 100B. In the case of setting the mixture ratio of the B component to the R component to "1:0.55" (the proportion is set to 0.55), the transmittance corresponding to the case of keeping the ON-level throughout the entire period of one frame is set to 0.55 when the B component is set to the maximum grayscale level. In the present embodiment, since the voltage with which the transmittance of 0.55 can be obtained is obtained as 3V according to the VT characteristic previously measured, the voltage of the ON-level is set to 3V.

The SF code conversion section 52 is for generating SF codes Scr, Scg, and Scb for the R component, G component, and B component, respectively, in accordance with the grayscale level of the video signal Da. It should be noted that in the present embodiment 8 bit data is used for the video signal Da to designate the grayscale level to be expressed by the pixel with 256 grayscale levels in a decimal expression from the darkest level of "0" to the brightest level of "255" with a step size of 1.

The SF code conversion section 52 has look-up tables (LUTs) showing the correspondence relationship between the grayscale level and the SF code for the respective colors, namely the R component, G component, and B component. Further, the LUTs are also provided for the respective mixture ratios between the R component, G component, and B component. For example, in the case in which the control signal Ca supplied from the image quality adjustment section 30 represents "1:1:1" as the mixture ratio between the R component, G component, and B component, the LUTs 200R, 200G, and 200B shown in FIGS. 5A through 5C are used to generate the SF codes Scr, Scg, and Scb. Further, in the case in which the control signal Ca represents "1:0.6:0.55" as the mixture ratio between the R component, G component, and B component, the SF codes Scr, Scg, and Scb are generated using the LUTs 201R, 201G, and 201B shown in FIGS. 6A through 6C.

The SF codes use the optical response in the liquid crystal element. The SF codes Scr, Scg, and Scb are each composed of 20 bits, namely bits c1 through c20, and the bits c1 through c20 are arranged in this order as the bits for designating the ON/OFF-drive of the respective sub-fields sf1 through sf20.

The SF codes shown in FIGS. 5A through 5C will now be explained. In the elements having relatively slow optical response such as the liquid crystal elements used in the present embodiment, the transmittance varies slowly in response to the application of the ON-level (or the OFF-level) to the pixel electrode. Therefore, in the normally-black mode, in comparison between the case of performing the ON-drive (application of the drive voltage of the ON-level) continuously in the temporally contiguous sub-fields and the case of performing the ON-drive discretely in the temporally separate sub-fields, the actual transmittance becomes higher (the element looks brighter) in the case of performing the ON-drive continuously than in the case of performing the ON-drive discretely even if the total period occupied by the ON-drive in the frame is the same. In the SF codes shown in FIGS. 5A through 5C, the characteristics described above are used.

It should be noted that in the case in which the mixture ratio between the R component, G component, and B component is "1:1:1", the voltage of the ON-level has the same value of 5V (the OFF-level is 0V) in all of the display panels 100R, 100G, and 100B, and therefore, the contents of the LUTs 200R, 200G, and 200B are all the same.

Meanwhile, in the case in which the mixture ratio between the R component, G component, and B component is "1:0.6:0.55", the voltage of the ON-level becomes 5V (the OFF-level becomes 0V) in the display panel 100R, 3.2V (the OFF-level becomes 0V) in the display panel 100G, and 3V (the OFF-level becomes 0V) in the display panel 100B. Since the voltage range (the dynamic range) between the ON-level and the OFF-level varies due to the variation in the ON-level, and the response speed of the liquid crystal also varies, an optimization is performed on the SF codes in the LUTs 200G, 200B shown in FIGS. 5A through 5C to obtain the LUTs 201G, 201B shown in FIGS. 6A through 6C in accordance with the voltage range so that the grayscale level can be varied in 256 levels, from 0 to 255. It should be noted that the SF code in each of the grayscale levels is different between the LUTs 201G, 201B.

Further, the SF codes are determined so that the lower the voltage of the ON-level becomes and the narrower the voltage range becomes, the longer the ON-drive continues even in the case of expressing the same grayscale level.

For example, looking at the rows with the grayscale level of 1 in the LUTs 201R, 201G, and 201B, the ON-drive is designated at the bit c1 while the OFF-drive is designated at the bits c2, c3 with respect to the R component with the highest voltage of the ON-level and the broadest voltage range. With respect to the G component with the intermediate voltage and range, the ON-drive is designated at the bits c1, c3 while the OFF-drive is designated at the bit c2. In contrast, with respect to the B component with the lowest voltage of the ON-level and the narrowest voltage range, the ON-drive is continuously designated at the bits c1, c2.

The memory control section 40 writes the SF codes Scr, Scg, and Scb into the memory 45 with the control by the timing control circuit 20. Further, the memory control section 40 retrieves the SF codes Scr, Scg, and Scb stored in the memory 45, and then outputs either one of the bits c1 through c20 of each of the SF codes thus retrieved as the SF bits Sbr, Sbg, and Sbb in accordance with the drive timing (the sub-field) in the display panels 100.

For example, when the drive timing in the display panels 100 is the sub-field sf5, the bit c5 is output as the SF bit out of the SF code stored. Further, when the drive timing in the display panels 100 is the sub-field sf13, the bit c13 is output as the SF bit out of the SF code stored.

As described above, in the present embodiment, the SF code conversion section 52 converts the video signal Da into the SF codes in accordance with the mixture ratio between the R component, G component, and B component, and then the data signal drive circuit 140 converts the SF bits output from the memory control section 40 into the data signals, and then supplies them to the data lines 114. Further, the scan line drive circuit 130 selects the scan line 112 corresponding to the row of the pixels to be supplied with the data signal, thereby performing the ON-drive or OFF-drive on the pixels. Further, in the present embodiment, it results that the ON-level of the data signal of the display panel corresponding to each of the colors is set in accordance with the mixture ratio between the R component, G component, and B component in the video signal Da.

Operation of First Embodiment

Then, an overall operation of the electro-optic device 10 according to the present embodiment will hereinafter be explained.

If the operation performed on the operator not shown is the instruction for setting the mixture ratio between the R component, G component, and B component in the image to be displayed to "1:1:1", the image quality adjustment section 30 outputs the control signal Ca representing the mixture ratio between the R component, G component, and B component to the SF code conversion section 52 and the voltage control section 60.

When obtaining the control signal Ca, the voltage control section 60 outputs the control signal Cbr, which gives an instruction for setting the voltage of the ON-level to 5V, to the data line drive circuit 140 related to the display panel 100R. Further, the voltage control section 60 outputs the control signal Cbg, which gives an instruction for setting the voltage of the ON-level to 5V, to the data line drive circuit 140 related to the display panel 100G, and the control signal Cbb, which gives an instruction for setting the voltage of the ON-level to 5V, to the data line drive circuit 140 related to the display panel 100B.

If the control signal Ca representing the mixture ratio of "1:1:1", the SF code conversion section 52 converts the video signal Da supplied from the image quality adjustment section 30 into the SF codes using the LUTs 200R, 200G, and 200B shown in FIGS. 5A through 5C.

Here, if the grayscale level of the R component in the video signal Da is 255, all of the 20 bits of bits c1 through c20 of the SF code Scr are set to "1". Further, if the grayscale level of the G component in the video signal Da is 255, all of the 20 bits of bits c1 through c20 of the SF code Scg are set to "1", and if the grayscale level of the B component in the video signal Da is 255, all of the 20 bits of bits c1 through c20 of the SF code Scb are set to "1". The SF codes Scr, Scg, and Scb generated in the SF code conversion section 52 are written into the memory 45 by the memory control section 40.

Figure 7A:
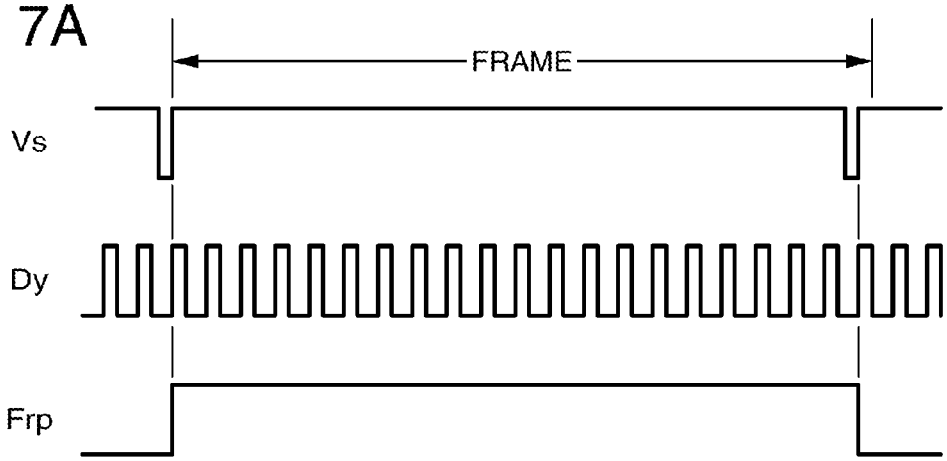
FIGS. 7A and 7B are diagrams showing an operation of a scan line drive circuit and so on in the electro-optic device.

Meanwhile, when the vertical synchronization signal Vs included in the synchronization signal Sync is supplied in such a manner as shown in FIG. 7A, the timing control circuit 20 supplies the scan line drive circuit 130 with start pulses Dy in accordance with the start timing of the sub-fields sf1 through sf20 at the pixels in the first row. It should be noted that the start pulses Dy are included in the control signal Yct supplied to the scan line drive circuit 130. In the control signal Yct, there is also included a clock signal (not shown) for transferring the start pulses Dy. Further, the timing control circuit 20 designates the reversal of the polarity of the data signal to the data signal drive circuit 140 every predetermined period, for example, one frame. Here, a signal Frp for designating the polarity is included in the control signal Xct supplied to the data line drive circuit 140.

Figure 7B:
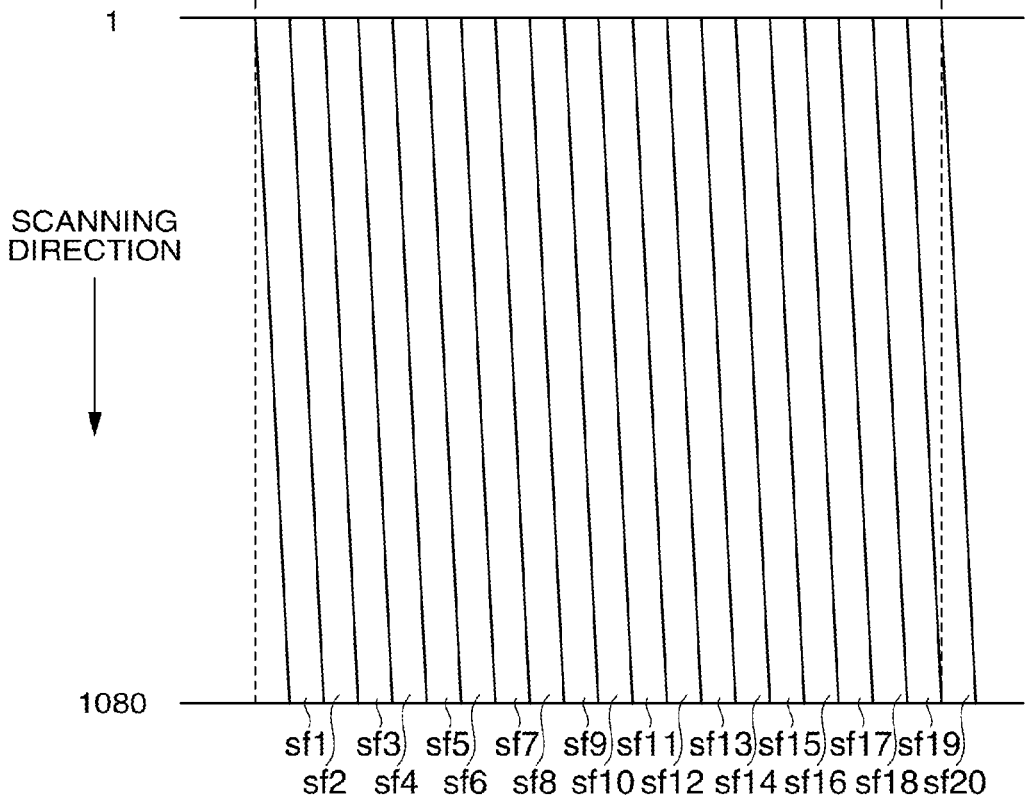

The scan line drive circuit 130 transfers the start pulses Dy in accordance with the clock signal described above, for example, thereby outputting the scan signals G1 through G1080. FIG. 7B is a diagram showing the temporal transition of the scan line selected by the scan signals G1 through G1080, assigning the 1st through 1080th lines of the scan line to the vertical axis, and time to the lateral axis. If the selection of the scan line is illustrated with a black bar for each of the scan lines, since the scan line is exclusively selected, the temporal transition in the selection of the scan line is actually illustrated with a series of black bars. However, for the sake of simple description, the temporal transition is illustrated with the downward-sloping solid lines in the drawing.

Regarding the supply of the SF bits Sbr, Sbg, and Sbb to the respective display panels 100R, 100G, and 100B, firstly, the memory control section 40 retrieves the SF codes Scr, Scg, and Scb of a certain row corresponding to the pixels of 1st through 1920th columns prior to the selection of the scan line of the row from the memory 45 with the control by the timing control circuit 20.

The memory control section 40 selects either one of the bits of the SF code Scr, thus retrieved, in accordance with the drive timing (the sub-field) of the display panel 100R at the present moment, and then outputs the bit. Further, the memory control section 40 selects and then outputs either one of the bits of the SF code Scg, thus retrieved, in accordance with the drive timing (the sub-field) of the display panel 100G at the present moment, and further selects and then outputs either one of the bits of the SF code Scb, thus retrieved, in accordance with the drive timing (the sub-field) of the display panel 100B at the present moment.

It should be noted that the timing control circuit 20 supplies the memory control section 40 with the number of times of output of the start pulses Dy in the frame defined by the vertical synchronization signal Vs as the information indicating the sub-field of the display panel 100 at the present moment. Thus, the memory control section 40 can obtain the drive timing (the sub-field) of the display panel 100 at the present moment.

Prior to selection of the scan line of a certain row by the scan line drive circuit 130, the SF codes Scr, Scg, and Scb of this row are retrieved from the memory 45, and then the SF bits Sbr, Sbg, and Sbb are supplied to the data line drive circuit 140. Therefore, it results that prior to the selection of the scan line, the data line drive circuit 140 is supplied with the SF bits Sbr, Sbg, and Sbb corresponding to pixels of the 1st through 1920th columns corresponding to the scan line, and corresponding to the sub-field to be written in the present selection.

The data line drive circuits 140 of the respective display panels 100R, 100G, and 100B convert the SF bits of the one whole row into the data signals having either one of the ON-level and OFF-level with the polarity designated by the respective timing control signal, and further supply the data lines 114 of the 1st through 1920th columns with the data signals when the scan line of the row is selected.

It should be noted that the data line drive circuits 140 set the voltages of the ON-levels of the data signals in accordance with the control signals Cbr, Cbg, and Cbb supplied from the voltage control section 60, respectively. As described above, since the control signals Cbr, Cbg, and Cbb are all for giving an instruction for setting the voltage of the ON-level to 5V, the data line drive circuit 140 of the display panel 100R sets the voltage of the ON-level to 5V. Further, the data line drive circuits 140 of the display panels 100G, 100B also set the voltages of the ON-level to 5V, respectively.

When the scan line of the row is selected, the data signal supplied to the data line 114 is applied to the pixel electrode 118 of the liquid crystal element 120 due to the TFT 116 corresponding to the row being set to the conductive state, and thus, the ON-drive or OFF-drive with the designated polarity is performed on the liquid crystal element 120 as a result.

It should be noted that although the TFT 116 is set to the non-conductive state when the selection of the present scan line is terminated, in the liquid crystal element 120 the voltage applied to the pixel electrode 118 when the TFT 116 is in the conductive state is held by the capacitive property of the liquid crystal element and the auxiliary capacitor 125, and therefore, the state of the ON-drive or OFF-drive is maintained until the scan line is selected next.

Such an operation as described above is performed sequentially with respect to the 1st through 1080th rows in one sub-field. Further, the operation in one sub-field is repeatedly performed in one frame in the order of the sub-fields sf1 through sf20.

Thus, since the ON-drive or OFF-drive is performed on each of the pixels in the sub-fields sf1 through sf20 in accordance with the respective SF bits, the average transmittance when regarding the frame as a unit period is set to a value corresponding to the grayscale level, and thus, it results that the grayscale can be expressed.

Then, the operation in the case of changing the mixture ratio between the R component, G component, and B component will be explained.

If the operation performed on the operator not shown is the instruction for setting the mixture ratio between the R component, G component, and B component in the image to be displayed to "1:0.6:0.55", the image quality adjustment section 30 outputs the control signal Ca representing the mixture ratio between the R component, G component, and B component to the SF code conversion section 52 and the voltage control section 60.

When obtaining the control signal Ca, the voltage control section 60 outputs the control signal Cbr, which gives an instruction for setting the voltage of the ON-level to 5V, to the data line drive circuit 140 related to the display panel 100R. Further, the voltage control section 60 outputs the control signal Cbg, which gives an instruction for setting the voltage of the ON-level to 3.2V, to the data line drive circuit 140 related to the display panel 100G, and the control signal Cbb, which gives an instruction for setting the voltage of the ON-level to 3V, to the data line drive circuit 140 related to the display panel 100B.

If the control signal Ca represents the mixture ratio of "1:0.6:0.55", the SF code conversion section 52 converts the video signal Da supplied from the image quality adjustment section 30 into the SF codes using the LUTs 201R, 201G, and 201B shown in FIGS. 6A through 6C.

Here, if the grayscale level of the R component in the video signal Da is 255, all of the 20 bits of bits c1 through c20 of the SF code Scr are set to "1". Further, if the grayscale level of the G component in the video signal Da is 255, all of the 20 bits of bits c1 through c20 of the SF code Scg are set to "1", and if the grayscale level of the B component in the video signal Da is 255, all of the 20 bits of bits c1 through c20 of the SF code Scb are set to "1". The SF codes Scr, Scg, and Scb generated in the SF code conversion section 52 are written into the memory 45 by the memory control section 40.

Then, when the vertical synchronization signal Vs included in the synchronization signal Sync is supplied in such a manner as shown in FIG. 7A, the timing control circuit 20 supplies the scan line drive circuit 130 with start pulses Dy in accordance with the start timing of the sub-fields sf1 through sf20 at the pixels in the first row. The scan line drive circuit 130 transfers the start pulses Dy in accordance with the clock signal described above, for example, thereby outputting the scan signals G1 through G1080.

Regarding the supply of the SF bits Sbr, Sbg, and Sbb to the respective display panels 100R, 100G, and 100B, firstly, the memory control section 40 retrieves the SF codes Scr, Scg, and Scb of a certain row corresponding to the pixels of 1st through 1920th columns prior to the selection of the scan line of the row from the memory 45 with the control by the timing control circuit 20.

The memory control section 40 selects either one bit of the SF code Scr thus retrieved in accordance with the drive timing (the sub-field) of the display panel 100R at the present moment, and then outputs the bit. Further, the memory control section 40 selects and then outputs either one of the bits of the SF code Scg, thus retrieved, in accordance with the drive timing (the sub-field) of the display panel 100G at the present moment, and further selects and then outputs either one of the bits of the SF code Scb, thus retrieved, in accordance with the drive timing (the sub-field) of the display panel 100B at the present moment.

The data line drive circuits 140 of the respective display panels 100R, 100G, and 100B convert the SF bits of the one whole row into the data signals having either one of the ON-level and OFF-level with the polarity designated by the respective timing control signal, and further supply the data lines 114 of the 1st through 1920th columns with the data signals when the scan line of the row is selected.

It should be noted that the data line drive circuits 140 set the voltages of the ON-levels of the data signals in accordance with the control signals Cbr, Cbg, and Cbb supplied from the voltage control section 60, respectively. As described above, since the control signal Cbr is for giving an instruction for setting the voltage of the ON-level to 5V, the data line drive circuit 140 of the display panel 100R sets the voltage of the ON-level to 5V. Further, since the control signal Cbg is for giving an instruction for setting the voltage of the ON-level to 3.2V, the data line drive circuit 140 of the display panel 100G sets the voltage of the ON-level to 3.2V. Further, since the control signal Cbb is for giving an instruction for setting the voltage of the ON-level to 3V, the data line drive circuit 140 of the display panel 100B sets the voltage of the ON-level to 3V.

When the scan line of the row is selected, the data signal supplied to the data line 114 is applied to the pixel electrode 118 of the liquid crystal element 120 due to the TFT 116 corresponding to the row being set to the conductive state, and thus, the ON-drive or OFF-drive with the designated polarity is performed on the liquid crystal element 120 as a result.

If the mixture ratio between the R component, G component, and B component is set to "1:0.6:0.55" while fixing the voltages of the ON-level in the display panels 100G, 100B to 5V (setting the OFF-level voltage to 0V), it results that the mixture ratio of "1:0.6:0.55" is realized by using the grayscale up to an intermediate level thereof in the display panels 100G, 100B. However, according to this configuration, since the SF codes corresponding to 0 through the intermediate level are fit into the 256 grayscale levels, the SF codes might become the same despite the fact that the grayscale levels in the video signal are different from each other in some cases, and the number of levels actually used in the display becomes smaller than 256 levels.

In contrast, according to the present embodiment, since the SF codes different from each other can be assigned respectively to the 256 levels of the grayscale, and the mixture ratio can be adjusted by the voltages of the ON-level, the display can be performed while varying the grayscale level between the 256 levels.

Second Embodiment

A second embodiment of the invention will hereinafter be described. Although the first embodiment described above relates to an example of dividing the frame into sub-fields with the same width, the second example relates to an example of dividing the frame into two groups, and further dividing each of the groups into sub-fields with periods different from each other. It should be noted that in the second embodiment the polarity of the data signal is switched by group, between the first group and second group, in accordance with the signal Frp.

Figure 8A:
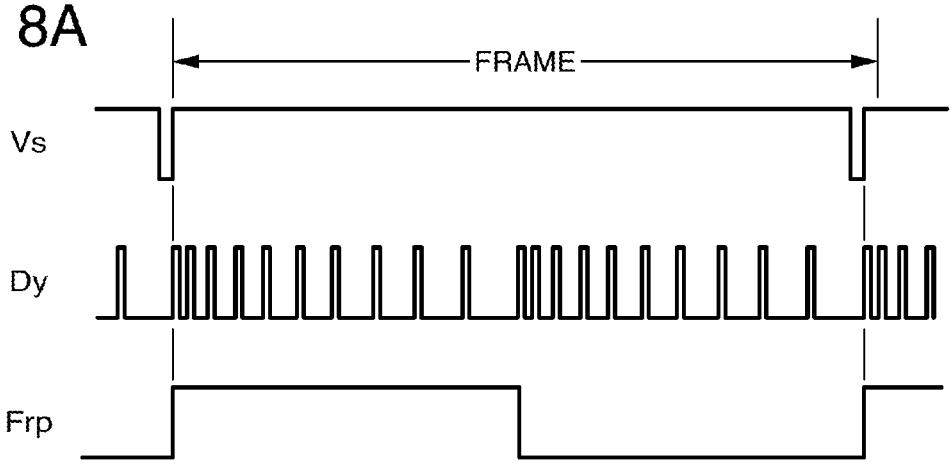
FIGS. 8A and 8B are diagrams showing an operation of a scan line drive circuit and so on in the electro-optic device according to a second embodiment.
Figure 8B:
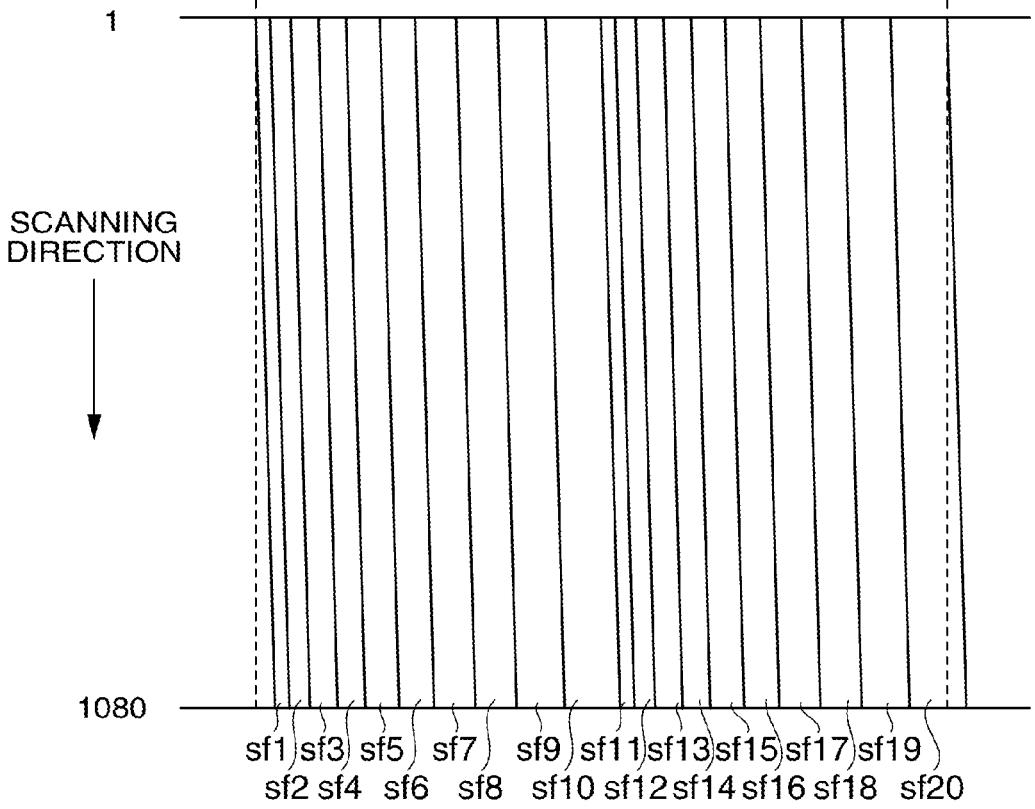

Specifically, as shown in FIG. 8A, in the present embodiment, the frame is divided into the first group and the second group, and further, each of the groups is divided into 10 sub-fields having respective weights (each denoting the size of the temporal length (period), and the case with a short period is denoted as a small weight and the case with a long period is denoted as a large weight) different from each other. Therefore, in the present embodiment, it results that one frame is composed of 20 sub-fields.

It should be noted that in the present embodiment in the case in which the mixture ratio between the R component, G component, and B component is "1:1:1", the weights of the respective sub-fields are the same between the display panels.

Figures 9, 10:
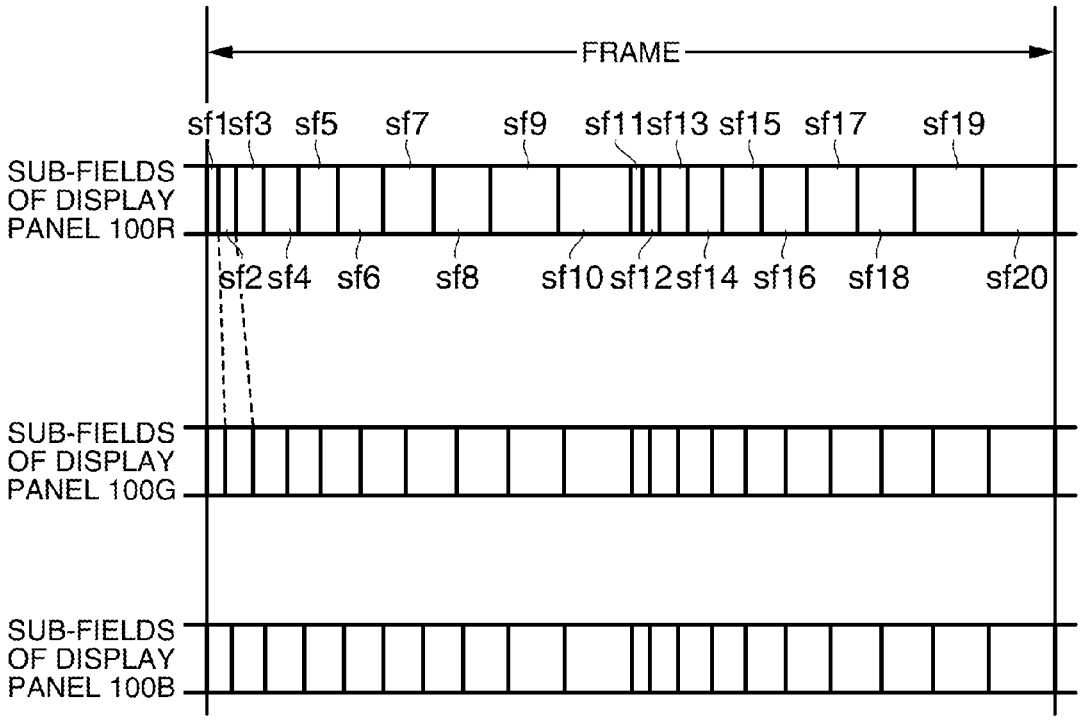
FIG. 9 is a diagram showing sub-fields according to the second embodiment.
FIG. 10 is a diagram showing an LUT 202R.

In contrast, if the mixture ratio between the R component, G component, and B component is changed to "1:0.6:0.55", the weights of the respective sub-fields are also changed in the display panels 100G, 100B. For example, as shown in FIG. 9, regarding the sub-fields with relatively small weight, the weight increases as the ON-level is lowered to narrow the voltage range between the ON-level and OFF-level of the drive voltage. Therefore, the weight of the sub-field sf1 of the display panel 100G becomes larger than that of the sub-field sf1 of the display panel 100R. Further, the weight of the sub-field sf1 of the display panel 100B becomes larger than that of the sub-field sf1 of the display panel 100G.

It should be noted that in the present embodiment, it is also possible to limit the sub-field, the weight of which increases as the ON-level is lowered to narrow the voltage range between the ON-level and OFF-level of the drive voltage, to predetermined sub-field ranges (e.g., sf1 through sf7, and sf11 through sf17). It should be noted that the sub-fields the weights of which are varied in accordance with the voltage range of the drive voltage are not limited to the sub-fields sf1 through sf7 and sf11 through sf17, but can be other sub-fields.

Further, since the widths of the sub-fields are not equal to each other in the present embodiment, the LUTs are made different from those in the first embodiment.

In the case in which the control signal Ca supplied from the image quality adjustment section 30 represents "1:1:1" as the mixture ratio between the R component, G component, and B component, the SF codes Scr, Scg, and Scb are generated using LUTs 202R, 202G, and 202B. It should be noted that although FIG. 10 shows the LUT 202R, the LUTs 202G, 202B have the same contents as the LUT 202R, and are therefore omitted from the drawing.

Further, in the case in which the control signal Ca supplied from the image quality adjustment section 30 represents "1:0.6:0.55" as the mixture ratio between the R, G, and B components, the SF codes Scr, Scg, and Scb are generated using LUT 203G shown in FIG. 11 and LUT 203B shown in FIG. 12 instead.

If the control signal Ca represents the mixture ratio of "1:1:1", the SF code conversion section 52 according to the present embodiment converts the video signal Da supplied from the image quality adjustment section 30 into the SF codes using the LUTs 202R, 202G, and 202B.

Here, if the grayscale level of the R component in the video signal Da is 253, the LUT 202R is referred to, and the SF code Scr is made to have the bits c1 through c10 in the first group of "0011111111", and the bits c11 through c20 in the second group of "0101111111".

Further, if the grayscale level of the G component in the video signal Da is 253, the LUT 202G is referred to, and the SF code Scg is made to have the bits c1 through c10 in the first group of "0011111111", and the bits c11 through c20 in the second group of "0101111111".

Further, if the grayscale level of the B component in the video signal Da is 253, the LUT 202B is referred to, and the SF code Scb is made to have the bits c1 through c10 in the first group of "0011111111", and the bits c11 through c20 in the second group of "0101111111".

The SF codes Scr, Scg, and Scb generated in the SF code conversion section 52 are written into the memory 45 by the memory control section 40.

In contrast, if the control signal Ca represents the mixture ratio of "1:0.6:0.55", the SF code conversion section 52 according to the present embodiment converts the video signal Da supplied from the image quality adjustment section 30 into the SF codes using the LUTs 202R, 203G, and 203B.

Here, if the grayscale level of the R component in the video signal Da is 253, the LUT 202R is referred to, and the SF code Scr is made to have the bits c1 through c10 in the first group of "0011111111", and the bits c11 through c20 in the second group of "0101111111".

Further, if the grayscale level of the G component in the video signal Da is 253, the LUT 203G is referred to, and the SF code Scg is made to have the bits c1 through c10 in the first group of "0011111111", and the bits c11 through c20 in the second group of "0011111111". In other words, the content of the SF code is optimized in accordance with the voltage of the ON-level being changed to change the voltage range between the ON-level and OFF-level.

Further, if the grayscale level of the B component in the video signal Da is 253, the LUT 203B is referred to, and the SF code Scb is made to have the bits c1 through c10 in the first group of "1011111111", and the bits c11 through c20 in the second group of "0011111111". In other words, also in this case, the content of the SF code is optimized in accordance with the voltage of the ON-level being changed to change the voltage range between the ON-level and OFF-level.

The SF codes Scr, Scg, and Scb generated in the SF code conversion section 52 are written into the memory 45 by the memory control section 40.

Electronic Apparatus

Figure 13:
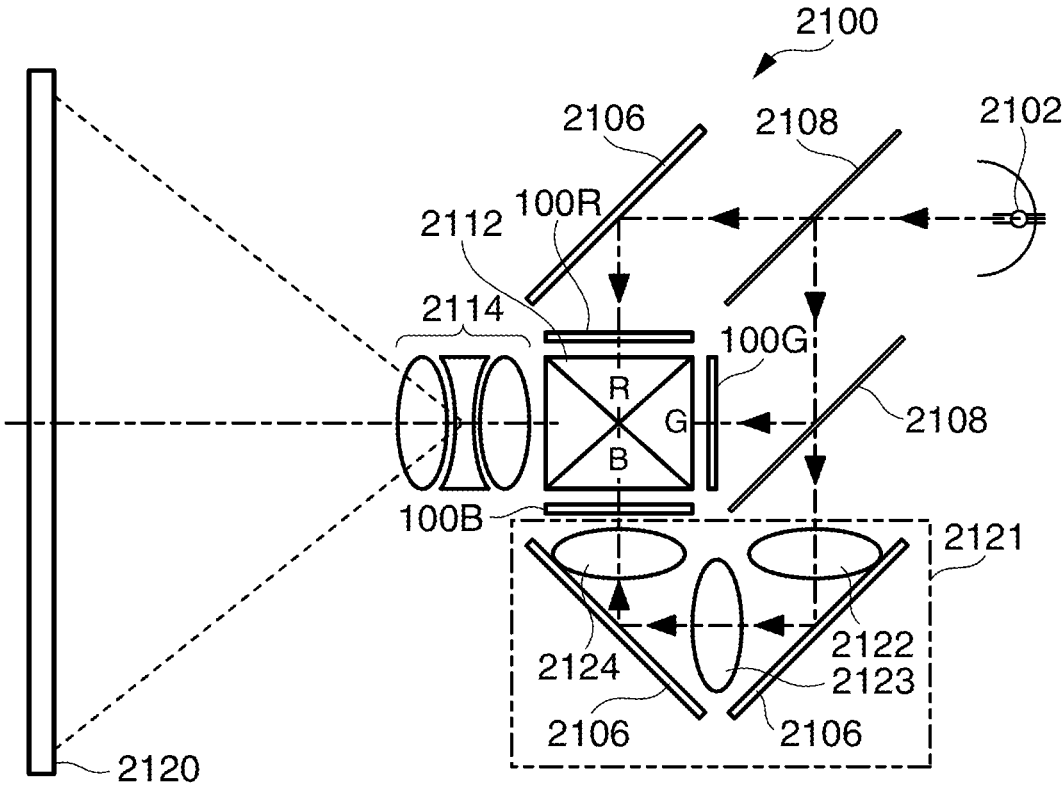
FIG. 13 is a diagram showing a configuration of a projector to which the electro-optic device is applied.

FIG. 13 is a diagram schematically showing a configuration of a projector as an example of an electronic apparatus according to an embodiment of the invention.

A projector 2100 is a projector using light valves. In the projector 2100, there is provided a lamp unit 2102 forming a white light source such as a halogen lamp. A projection light beam emitted from the lamp unit 2102 is separated by three mirrors 2106 and two dichroic mirrors 2108 disposed inside into three primary colors of R (red), G (green), and B (blue), and then respectively guided to the light valves 100R, 100G, and 100B corresponding to the respective colors. It should be noted that since the B color light beam has a longer light path compared to the other colors, the R color and G color, and is therefore guided via a relay lens system 2121 composed of an entrance lens 2122, a relay lens 2123, and an exit lens 2124 in order to prevent the loss.

In the projector 2100, the display panels 100R, 100G, and 100B of the electro-optic device 10 according to the first embodiment or the second embodiment described above correspond to the light valves 100R, 100G, and 100B, respectively. Further, there is a configuration in which the video signals corresponding respectively to the R color, G color, and B color are supplied from the higher-level circuit and then converted into the SF codes, and then the SF bits out of the SF codes corresponding to the position of the pixels or the like are selected.

The light valves 100R, 100G, and 100B are respectively driven by sub-field in accordance with the SF bits corresponding respectively to the R color, G color, and B color. The light beams respectively modulated by the light valves 100R, 100G, and 100B enter a dichroic prism 2112 in three directions. Then, in the dichroic prism 2112, the light beams of the R color and B color are refracted 90 degrees while the light beam of the G color goes straight. Therefore, it results that after the images of the respective colors are combined, the color image is projected by a projection lens 2114 to a screen 2120.

It should be noted that since the light beams corresponding respectively to the R color, G color, and B color enter the light valves 100R, 100G, and 100B due to the dichroic mirrors 2108, no color filter is required to be disposed. Further, since the transmission images of the light valves 100R, 100B are reflected by the dichroic prism 2112 and then projected while the transmission image of the light valve 100G is projected directly, there is adopted the configuration in which the horizontal scanning direction of the light valves 100R, 100B is set to the reverse direction of the horizontal scanning direction of the light valve 100G to thereby display the mirror reversed images.

Besides the apparatus explained with reference to FIG. 13, as the electronic apparatus there can be cited televisions, video cassette recorders of viewfinder types or direct monitor types, car navigation systems, pagers, personal digital assistants, electric calculators, word processors, workstations, picture phones, POS terminals, digital still cameras, mobile phones, apparatuses equipped with a touch panel and so on. Further, it is obvious that the electro-optic devices described above can be applied to the various types of electronic apparatuses cited above.

Modified Examples

Although the embodiments of the invention are described hereinabove, the invention is not limited to the embodiments described above, but can be put into practice in other various forms. For example, the invention can be put into practice by modifying the embodiments described above as follows. It should be noted that it is also possible to combine the embodiments described above and the following modified examples with each other.

Although in the embodiments described above as the mixture ratio between the R component, G component, and B component there are selected "1:1:1" and "1:0.6:0.55", these mixture ratios are illustrative only, and the mixture ratios other than these mixture ratios can also be selected.

Although in the embodiments described above the voltage control section 60 outputs the control signals Cbr, Cbg, and Cbb, it is also possible for the image quality adjustment section 30 to output the control signals Cbr, Cbg, and Cbb to the data line drive circuit 140.

Although in the embodiment described above the ON-level is set throughout the entire period of one frame at the maximum grayscale level, it is not necessarily required to set the ON-level throughout the entire period of the frame at the maximum grayscale level.

In the invention the liquid crystal element 120 constituting the pixel 110 is not limited to the transmissive type, but can also be of a reflective type. Further, the liquid crystal element is not limited to the normally-black mode, but can also be of a normally-white mode.

Here, assuming that the liquid crystal element 120 is of the normally white mode, the ON-level denotes the level of the data signal for setting the liquid crystal element 120 to the dark state by applying the voltage to the liquid crystal element 120, and the OFF-level denotes the level of the data signal for setting the liquid crystal element 120 to the light state.

It should be noted that if the normally-white mode is adopted, the value "1" or "0" of each of the bits of the SF code in each of the LUTs described above is reversed.

Further, if the normally-white mode is adopted, the voltage of the ON-level is set to 5V, and the voltage of the OFF-level is changed in accordance with the mixture ratio between the R component, G component, and B component. Specifically, in the case of setting the mixture ratio between the R component, G component, and B component to "1:1:1" in the normally-white mode, assuming that the OFF-levels of the respective components are set to 0V, the respective ON-levels are set to 5V. Further, in the case of setting the mixture ratio between the R component, G component, and B component to "1:0.6:0.55", the OFF-levels are set to 0V, 2V, and 2.2V, respectively in accordance with the VT characteristic, and the voltages of the ON-level are set to 5V, 5V, and 5V, respectively. Therefore, the voltage range between the ON-level and OFF-level of the drive voltage for the R, G, and B components become 5V, 3V, and 2.8V, respectively, and the voltage range for the B component becomes the narrowest.

It should be noted that in the normally-white mode the ON-drive denotes the drive of supplying the voltage of the ON-level, namely the data signal for setting the liquid crystal element 120 to the dark state, and in the normally-white mode the OFF-drive denotes the drive of supplying the voltage of the OFF-level, namely the data signal for setting the liquid crystal element 120 to the light state. It should be noted that there can be cited another example in which the OFF-level is set to 5V in the case of the positive polarity, and to −5V in the case of the negative polarity.

Although in the embodiments described above the video signal Vid is the signal representing the image with three primary colors, namely the three components of red (R), green (G), and blue (B), the video signal Vid can also be a signal including more than three color components such as cyan (C), magenta (M), yellow (Y), and white (W).

Although in the embodiments described above the number of sub-fields is set to 20, the number is not limited to 20, but can also be smaller or larger than 20.

In the invention the display element is not limited to the liquid crystal element 120, but the invention can be applied to, for example, an EL element.

In the embodiments described above the voltages of the ON-level in the case of setting the mixture ratio between the R component, G component, and B component to "1:0.6:0.55" are set to 5V, 3.2V, and 3V, respectively, and the order of the components sorted by the proportion in the mixture ratio and the order of the components sorted by the voltage of the ON-level coincide with each other. However, since the voltage of the ON-level is determined in accordance with the VT characteristic as described above, there can be the case in which the order of the components sorted by the proportion in the mixture ratio and the order of the components sorted by the voltage of the ON-level do not coincide with each other. As described above, the drive voltages corresponding to the mixture ratio between two or more of color components can be the drive voltages achieving the mixture ratio.

Although in the embodiments described above the three display panels 100R, 100G, and 100B corresponding respectively to the three colors of R, G, and B are driven, it is also possible to adopt a configuration of providing three types of pixels R, G, and B corresponding respectively to the three colors to a single display panel, and driving the respective pixels in accordance with the mixture ratio.

Although in the electronic apparatus described above the electro-optic device 10 alone controls the three display panels 100R, 100G, and 100B corresponding respectively to the three colors of R, G, and B, it is also possible to arrange that one electro-optic device controls one display panel 100, and three electro-optic devices corresponding respectively to the three colors of R, G, and B are provided. In the case of this configuration, the video signal is separated into colors, and the video signals thus separated are input to the electro-optic devices corresponding to the respective colors. Further, the LUTs are provided to the SF code conversion section 52 so as to correspond to the respective electro-optic devices corresponding to the colors.

The entire disclosure of Japanese Patent Application No. 2010-009126, filed Jan. 19, 2010 is expressly incorporated by reference herein.

What is claimed is:

1. An electro-optic device comprising:

a first pixel which displays a first color;

a second pixel which displays a second color which is different from the first color;

a third pixel which displays a third color which is different from the first color and the second color; and a drive section adapted to drives the first pixels, the second pixel and the third pixel based on a sub-fields code and a mixture ratio of the first color, the second color and the third color to display a image, the sub-fields code corresponding to a grayscale level of the image and designating one of an ON-state and an OFF-state of the first pixel, the second pixel and the third pixel at each of sub-fields constituting the image, the mixture ratio being constant regardless of the grayscale of the image, wherein the drive section supplies a first voltage to the first pixel based on the mixture ratio at the ON-state of the first pixel, supplies a second voltage to the second pixel based on the mixture ratio at the ON-state of the second pixel, and supplies a third voltage to the third pixel based on the mixture ratio at the ON-state of the third pixel, the first voltage being different from the second voltage.

2. The electro-optic device according to claim 1, further comprising:

an adjustment section which adjusts the mixture ratio of the first color, the second color, and the third color at maximum grayscale level to adjust a white balance of the image; and a conversion section converts a video signal to the sub-fields code.

3. The electro-optic device according to claim 1, wherein the sub-fields have respective periods of the same duration, and if the first voltage is higher than the second voltage, the sub-fields code of the first pixel has a longer period which the ON-state of the pixel continues as compared to the sub-fields code of the second pixel.

4. The electro-optic device according to claim 1, wherein at the maximum grayscale level, the first pixel, the second pixel, and the third pixel are driven with the sub-fields code designating the ON-state of each of the first pixel, the second pixel, and the third pixel at all of the sub-fields.

5. An electronic apparatus comprising the electro-optic device according to claim 1.

6. An electro-optic device comprising:

a first panel including a plurality of first pixels which display a first color;

a second panel including a plurality of second pixels which display a second color which is different from the first color;

a third panel including a plurality of third pixels which display a third color which is different from the first color and the second color;

a first drive section which drives one of the plurality of first pixels based on a first sub-fields code and a mixture ratio of the first color, the second color, and the third color to display a first image, the first sub-fields code corresponding to a grayscale level of the first image and designating one of an ON-state and an OFF-state of the one of the plurality of first pixels at each of sub-fields constituting the image, the mixture ratio being constant regardless of the grayscale of the first image;

a second drive section which drives one of the plurality of second pixels based on a second sub-fields code and the mixture ratio to display a second image, the second sub-fields code corresponding to a grayscale level of the second image and designating one of an ON-state and an OFF-state of the one of the plurality of second pixels at each of sub-fields constituting the second image, the mixture ratio being constant regardless of the grayscale of the second image; and a third drive section which drives one of the plurality of third pixels based on a third sub-fields code and the mixture ratio to display a third image, the third sub-fields code corresponding to a grayscale level of the third image and designating one of an ON-state and an OFF-state of the one of the plurality of third pixels at each of sub-fields constituting the third image, the mixture ratio being constant regardless of the grayscale of the third image, wherein:

the first drive section supplies a first voltage to the one of the plurality of first pixels based on the mixture ratio at the ON-state of the plurality of first pixels, the second drive section supplies a second voltage to the one of the plurality of second pixels based on the mixture ratio at the ON-state of the plurality of second pixels, and the third drive section supplies a third voltage to the one of the plurality of third pixels based on the mixture ratio at the ON-state of the plurality of third pixels, the first voltage being different from the second voltage.

7. The electro-optic device according to claim 6, further comprising:

an adjustment section which adjusts the mixture ratio of the first color, the second color, and the third color at maximum grayscale level to adjust a white balance of the image; and a conversion section which converts a first video signal to the first sub-fields code, a second video signal to the second sub-fields code and a third video signal to the third sub-fields code.

8. An electronic apparatus comprising the electro-optic device according to claim 6.

* * * * *